US006607352B1

(12) United States Patent
Crane et al.

(10) Patent No.: US 6,607,352 B1
(45) Date of Patent: Aug. 19, 2003

(54) TURBO MACHINE WITH AN INNER HOUSING AND AN OUTER HOUSING

(75) Inventors: Laurence Crane, Dublin (IE); Edwin Gobrecht, Ratingen (DE); Joe Hannon, Dublin (IE); Volker Simon, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 311 days.

(21) Appl. No.: 09/684,248

(22) Filed: Oct. 6, 2000

Related U.S. Application Data

(63) Continuation of application No. PCT/EP99/02375, filed on Apr. 6, 1999.

(30) Foreign Application Priority Data

Apr. 6, 1998 (EP) ..... 98106290

(51) Int. Cl.[7] ..... F01D 25/26

(52) U.S. Cl. ..... 415/108; 415/213.1; 415/214.1; 415/220; 415/177

(58) Field of Search ..... 415/108, 213.1, 415/214.1, 220, 177

(56) References Cited

U.S. PATENT DOCUMENTS

| | | | | |
|---|---|---|---|---|
| 3,592,557 A | * | 7/1971 | Haas et al. | 415/108 |
| 3,746,463 A | | 7/1973 | Stock et al. | |
| 3,754,833 A | * | 8/1973 | Remberg | 415/108 |
| 4,362,464 A | * | 12/1982 | Stock | 415/108 |
| 5,388,960 A | | 2/1995 | Suzuki et al. | |

FOREIGN PATENT DOCUMENTS

| | | |
|---|---|---|
| DE | 3522916 A1 | 1/1987 |
| GB | 740944 | 11/1955 |

* cited by examiner

*Primary Examiner*—Edward K. Look
*Assistant Examiner*—Igor Kershteyn
(74) *Attorney, Agent, or Firm*—Laurence A. Greenberg; Werner H. Stemer; Gregory L. Mayback

(57) ABSTRACT

A turbo machine, especially a steam turbine, has a main axis, an inner housing, an outer housing, a top region, and a bottom region. Between the outer housing and the inner housing a radial gap is formed, which has a narrow part in the bottom region.

11 Claims, 3 Drawing Sheets

TURBO MACHINE WITH AN INNER HOUSING AND AN OUTER HOUSING

CROSS-REFERENCE TO RELATED APPLICATION

This is a continuation of International Application PCT/EP99/02375, filed Apr. 6, 1999, which designated the United States.

BACKGROUND OF THE INVENTION

FIELD OF THE INVENTION

The invention relates to a turbo machine, especially a steam turbine having an inner housing and an outer housing spaced apart, so that a gap is formed between the inner housing and the outer housing.

It is known, as described in Published, Non-Prosecuted German Patent Application DE 35 22 916 A1 that during the operation of a turbo machine, especially a steam turbine, the inner housing, the outer.housing as well as the turbine rotor elongate to a different amount due to different temperatures acting on these parts. It is therefore normal practice to compensate for the difference in the axial elongation between the housings and the turbine rotor by translation related methods and/or devices. As the temperatures acting on the inner housing and the outer housing are also different, there may arise a temperature gradient in the inner housing and the outer housing which may lead to different deformations during operation of the turbo machine as well as during the cooling down of the turbo machine.

British Patent No. 740 944 relates to thermal turbines, more specially steam turbines, which contain an internal housing separated from an external housing by a gap. The turbine is driven by a driving medium, a part of which is branched off and passed through the gap between the internal and the external housing. During the operation of the turbine this part of the driving medium acts as a cooling medium for the external housing, so that the hot inner housing is thermally separated from the cold outer housing. Fins are secured on the inner face of the external housing in order to improve the heat transfer on the outer housing.

U.S. Pat. No. 5,388,960 relates to a forced-air-cooling apparatus of a steam turbine in a high temperature state just after an operation shut down of the steam turbine. This apparatus serves for safe and quick cooling of the turbine.

U.S. Pat. No. 3,746,463 relates to a multi-stage axial flow steam turbine having an inner and an outer casing. The inner casing is mounted within the outer casing in such a manner as to limit relative axial movement and allow free relative radial movement between the inner and outer casing, which is caused by changes in temperature. The inner casing therefore is mounted within the outer casing by a plurality of keys and keyways, fitted pins and axial alignment fits, is obtained by tongue and groove portions which locate the inner casing axially with respect to the outer casing and yet allow free radial movement of the inner casing with respect to the outer casing.

SUMMARY OF THE INVENTION

It is accordingly an object of the invention to provide a turbo machine with an inner housing and an outer housing which overcomes the above-mentioned disadvantages of the prior art devices of this general type, in which thermal deformations of the outer housing are smaller than a critical value.

With the foregoing and other objects in view there is provided, in accordance with the invention, a turbo machine having a main axis; an inner housing; an outer housing surrounding the inner housing forming a radial gap therebetween; a top region disposed within the outer housing; and a bottom region disposed within the outer housing. A mounting region for mounting the inner housing on the outer housing is provided. A blading region extends along the main axis and is disposed within the outer housing. The radial gap has a narrowed part in the bottom region and the narrowed part extends along the main axis outside of the mounting region at least partially overlapping the blading region in a direction of the main axis.

The invention relies on the physical effect that during the shut down of the turbo machine the inner housing and the outer housing are at different temperatures. Due to the difference in temperature, a gaseous medium, like steam in the gap (space) between the inner housing and the outer housing is set in a thermal convection motion (temperature gradient driven flow) directed from the bottom region to the top region of the turbo-machine. This may lead to a temperature difference in the outer housing with a higher temperature in the top region as in the bottom region. Such a temperature gradient in the outer housing across the height of the outer housing may lead to a buckling of the outer housing (outer casing) from the top region to the bottom region. Under some critical conditions this may lead to a radial displacement of the inner housing and a rubbing of the moving blades of the rotor on the inner housing (inner casing).

The narrowing of the gap between the inner housing and the outer housing in the bottom region leads to a better transmission of heat from the inner housing to the outer housing as well as to a higher convection rate, especially a turbulent convection, in the top region. This leads to a super-linear temperature profile across the height of the outer casing. Therefore, the temperature profile in the outer casing has a temperature gradient (change of temperature per unit length AT/AH) in the bottom area which is greater than 1. The thermal stresses in the outer casing are therefore reduced, so that the chance of buckling of the outer casing along the main axis is reduced.

In accordance with another feature of the invention, the inner housing extends in the gap towards that outer housing, so that the gap, the space between inner housing and outer housing, is reduced along the main axis. The invention is also applicable for a turbine, in particular a steam turbine, having a blade region for the guide blades (vanes) instead of the inner housing or in addition to the inner housing.

In accordance with a further feature of the invention, a heat conducting extra mass is thermally coupled with the inner housing and situated in the bottom region. The extra mass may be of the same material as the inner housing. It is possible that the extra mass is part of the inner housing, especially cast as one piece together with the inner housing, welded to the inner housing or fastened to the inner housing in a suitable way. In accordance with an added feature of the invention, the extra mass or extra part of the inner housing may have approximately a triangular cross section, a rectangular cross section or another cross section which is suitable, according to the special geometry of the inner housing and outer housing as well as the physical parameters for the operation of the turbo machine.

The extra mass or extra part of the inner housing is preferably directed along the main axis and provides a rib or fin on the inner housing.

In accordance with an additional feature of the invention, a compensating mass is situated in the top region, in particular, the compensating mass is connected to the inner housing. The compensation mass leads to a contribution of mass of the inner housing, so that the center line of mass coincides with the main axis of the turbo machine. The compensation mass may have a similar shape as the extra mass so that a symmetry of the inner housing will be established. The compensating mass is also preferably directed along the main axis.

It is also in principle possible that the outer housing extends towards the inner housing in the bottom region to narrow the gap between inner housing and outer housing.

The turbo machinery is preferably a high pressure steam turbine or an intermediate pressure steam turbine.

In accordance with a further feature of the invention, the inner housing contains two housing parts that are separable from each other along a horizontal plain. Each housing part has preferably a horizontal radially outward directed flange. The housing parts are preferably mechanically fixed together through the flanges. For fastening the flanges together, commonly nuts and bolts or the like can be used. The flanges also reduce the gap between the inner housing and the outer housing in a horizontal plain between the top region and the bottom region. A convectional flow of steam from the bottom region to the top region or vice versa is in this case restricted. Under these circumstances a narrowing of the gap in the bottom region due to the narrow part is most effective, in the sense that heat transmission between inner housing and outer housing is improved and the temperature in the outer housing in the bottom region is raised.

Other features which are considered as characteristic for the invention are set forth in the appended claims.

Although the invention is illustrated and described herein as embodied in a turbo machine with an inner housing and an outer housing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
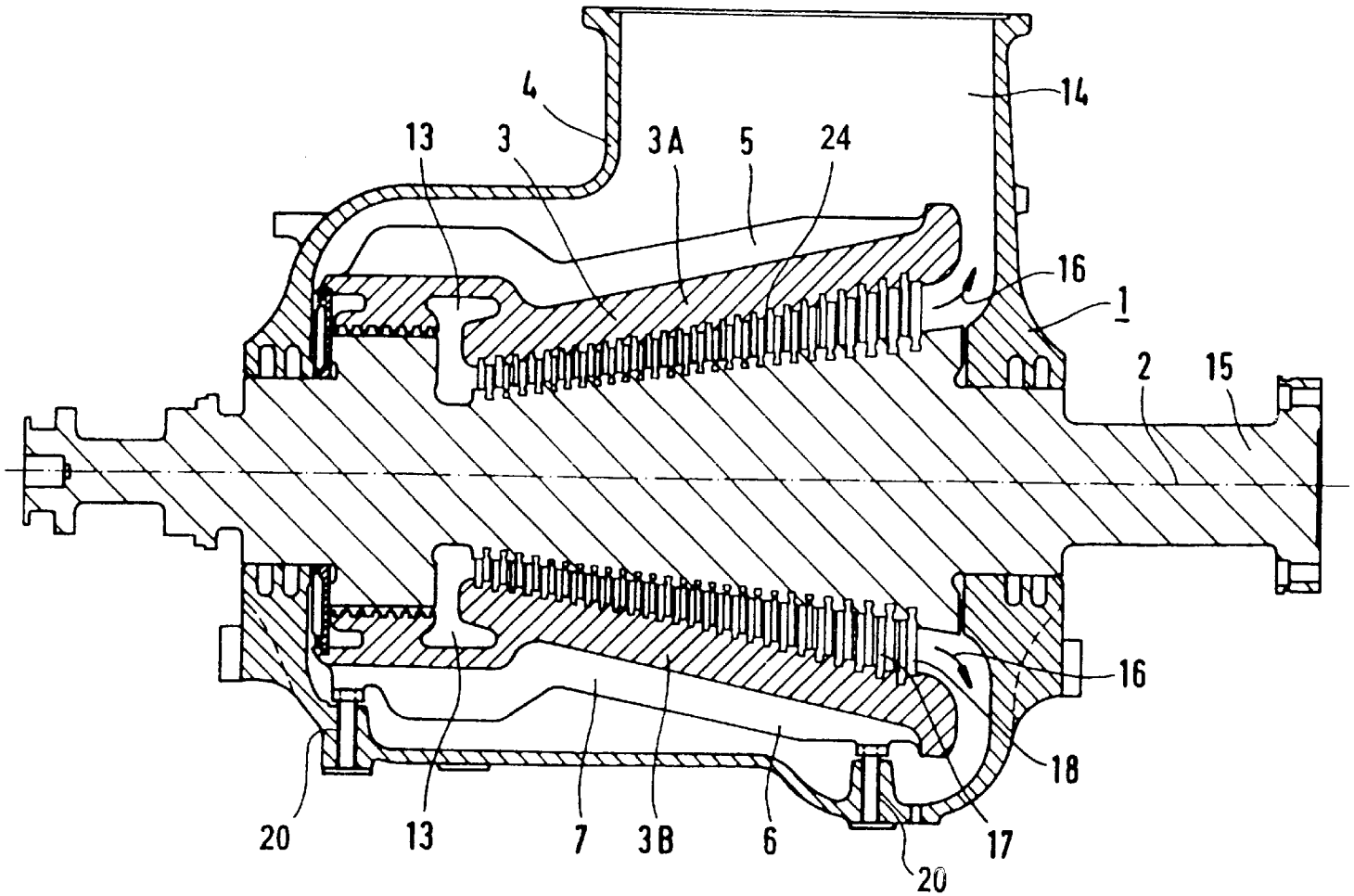
FIG. 1 is a diagrammatic, sectional view taken along a main axis of an intermediate steam turbine according to the invention.

In the drawing, the parts of a turbo machine which are useful to understand the invention are described in detail and those parts commonly used for the turbo machine are not described in detail. In all the figures of the drawing, sub-features and integral parts that correspond to one another bear the same reference symbol in each case. Referring now to the figures of the drawing in detail and first, particularly, to FIG. 1 thereof, there is shown a sectional view through a high pressure steam turbine 1 along a main axis 2 of the steam turbine 1. The steam turbine 1 contains a turbine rotor 15 that carries moving blades 17. The turbine rotor 15 is axially and circumferentially surrounded by an inner housing 3 which carries guide blades 18. The moving blades 17 and the guide blades 18 (vanes) are disposed in a blading region 24, which extends along the main axis 2. The inner housing 3 is surrounded by an outer housing 4. During operation of the steam turbine 1 intermediate pressurized steam flows from an inflow region 13 to an outflow region 14 between which the guide blades 18 and the moving blades 17 are situated. The outer housing 4 is mounted on the inner housing 3 in a mounting region 20 located near the inflow region 13 and near the outflow region 14. The inner housing 3 contains two housing parts 3A, 3B. The housing part 3B is located in a bottom region 6 of the steam turbine 1 and the housing part 3A is located in a top region 5 of the steam turbine 1. Between the inner housing 3 and the outer housing 4 a radial gap 7 remains, which gap 7 has a circular ringlike cross section and extends along the main axis 2. The gap 7 is narrowed in the bottom region 6 (narrow part 8, see FIGS. 4 and 5) along the main axis 2 at least partially axially overlapping the blading region 24 outside, in particular in between, the mounting regions 20.

Figure 2:
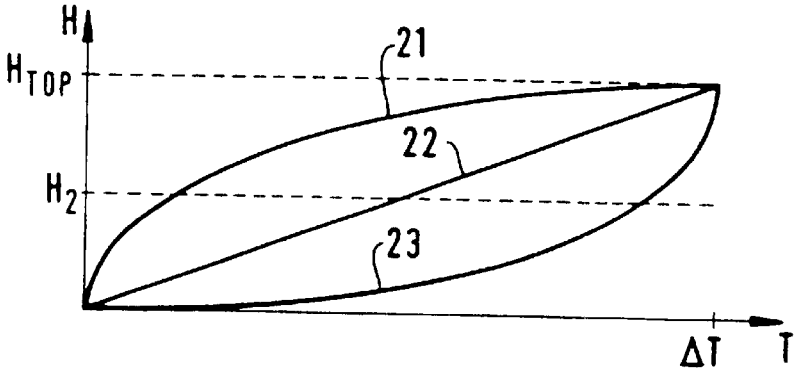
FIG. 2 is a graph of different temperature profiles across a height of an outer housing of the steam turbine.

In FIG. 2 three different temperature profiles 21, 22, 23 are shown across a height of the outer housing 4. The height of the outer housing 4 is counted from the bottom of the outer casing 4 to the top of the outer casing 4. The height of the outer casing 4 at a top is called $H_{top}$ and the height of the outer casing 4 at the main axis 2 is called $H_2$. The temperature difference between the bottom and the top of the outer casing 4 is called $\Delta T$. The temperature profile 22 is a linear temperature profile. The temperature profile 23 is a super linear temperature profile in which the temperature difference between the bottom and the main axis 2 is greater than the temperature difference between the main axis and the top. Temperature profile 21 is sub-linear, in which the temperature difference between the bottom and the main axis 2 is smaller than the temperature difference between the main axis 2 and the top of the outer casing 4.

Figure 3:
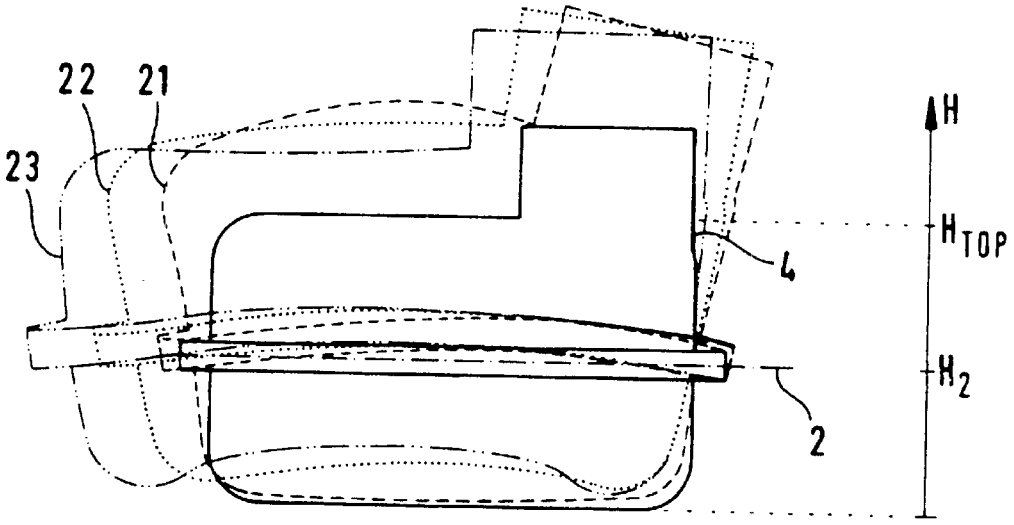
FIG. 3 is a side-elevational view of thermal deformation along the main axis due to the temperature gradients shown in FIG. 2.

These temperature profiles 21, 22, 23 lead to a different buckling of the outer casing 4 along the main axis 2. FIG. 3 shows the result of a numerical calculation of the buckling of the outer casing 4 for the temperature profiles shown in FIG. 2.

Figure 4:
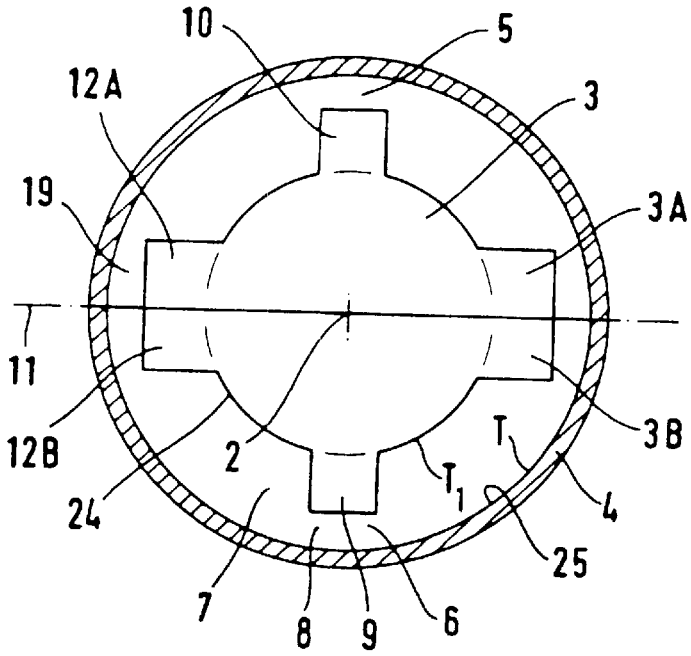
FIGS. 4 and 5 are cross-sectional views through the steam turbine of FIG. 1.
Figure 5:
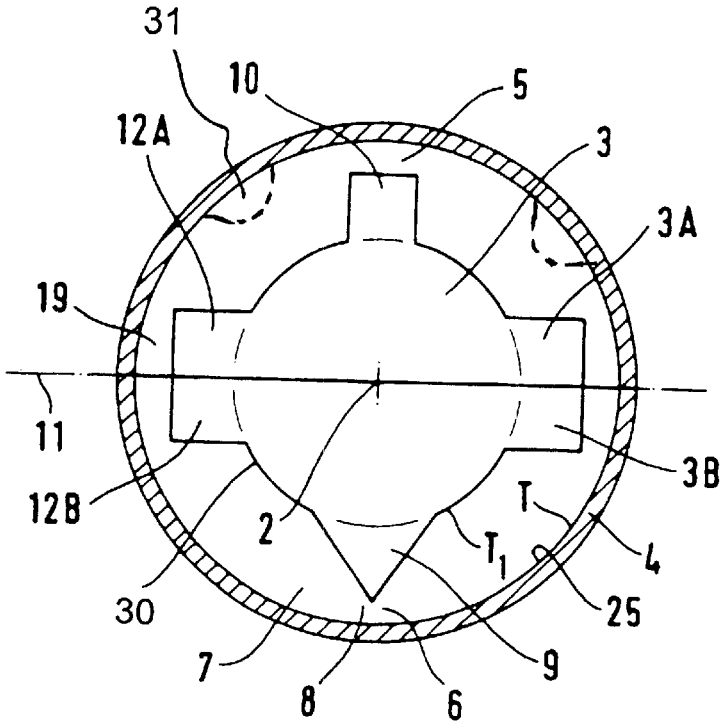

In FIGS. 4 and 5 a cross sectional view through the steam turbine 1 is shown. The inner housing 3 contains the two housing parts 3A, 3B that are fitted together on a horizontal plain 11. Each of the housing parts 3A, 3B has two flanges 12A, 12B which are situated opposite to each other. The outer casing 4 has a circular ring-like cross section. The inner housing 3 (inner casing) has a circular cross section with radially outward directed fins. Two of these fins are formed by the horizontal flanges 12A, 12B. Vertically directed fins are formed by an extra mass 9 that is located in the bottom region 6 of the steam turbine 1. A further vertical fin is formed by a compensation mass 10 located in the top region 5 of the steam turbine 1. Between the outer housing 4 and the inner housing 3 the ring-like radial gap 7 remains. The gap 7 is narrowed in the region of the horizontal plane 11 by the flanges 12A, 12B. Between the outer casing 4 and the flanges 12A, 12B a horizontal narrow part 19 of the gap 7 is provided. A further narrow part 8 of the gap 7 is formed by the extra mass 9 that extends in the gap 7 towards the outer casing 4. In the embodiment according to FIG. 4, all of the fins (the extra mass 9, the compensation mass 10 and the flanges 12A, 12B) have approximately a rectangular cross section. The compensation mass 10 and the extra mass 9 extend along the main axis at least partially outside the mounting regions 20 (mounting devices) and axially overlapping (at least partially) the blading region 24.

In FIG. 5 the extra mass 9 has an approximately triangular cross section. It is also possible to provide the compensation mass 10 also with an approximately triangular cross section.

It is further possible that the outer casing 4 has regions that extend toward the inner casing 3 as is shown by the is dashed lines identified by reference numeral 31.

During shut down and cooling of the turbo machinery 1, a natural convection of gaseous medium, steam, in the gap 7 is started. Due to the extra mass 9 heat from the inner casing 3 is transmitted to the outer housing 4 in such an amount that natural convection occurs also in the gap between the narrow part 8 and the horizontal narrow part 19. Due to this convection heat is also transferred to the outer housing 4 so that a temperature T on an inner surface 25 of the outer housing 4 is increased in the region between the narrow part and the horizontal plain 11. The temperature of the inner housing 3 on an outer surface 30 does not change very much on the outer surface 30.

We claim:

1. A turbo machine, comprising:

a main axis;

an inner housing;

an outer housing surrounding said inner housing forming a radial gap there-between;

a top region disposed within said outer housing;

a bottom region disposed within said outer housing;

a mounting region for mounting said inner housing on said outer housing;

a blading region extending along said main axis and disposed within said outer housing, said radial gap having a narrow part in said bottom region and said narrow part extending along said main axis outside said mounting region at least partially overlapping said blading region in a direction of said main axis; and an extra mass disposed in said bottom region, said extra mass being heat-conducting and thermally coupled with said inner housing.

2. The turbo machine according to claim 1, wherein said inner housing extends towards said outer housing to form said narrow part of said radial gap.

3. The turbo machine according to claim 1, wherein said extra mass has a cross-section shape selected from the group consisting of triangular cross-section shape and rectangular cross-section shape.

4. The turbo machine according to claim 1, wherein said extra mass is directed along said main axis.

5. The turbo machine according to claim 1, including a compensating mass disposed in said top region.

6. The turbo machine according to claim 1, wherein in said bottom region, said outer housing extends towards said inner housing.

7. The turbo machine according to claim 1, wherein the turbo machine is one of a high-pressure steam turbine and an intermediate pressure steam turbine.

8. The turbo machine according to claim 1, wherein said inner housing has two housing parts, said two housing parts being separable from each other along a horizontal plane.

9. The turbo machine according to claim 8, wherein each of said two housing parts has a horizontal radially outward directed flange.

10. The turbo machine according to claim 5, wherein said compensating mass is connected to said inner housing.

11. The turbo machine according to claim 1, wherein the turbo machine is a steam turbine.

* * * * *